US012590354B2

(12) United States Patent
Meng et al.

(10) Patent No.: US 12,590,354 B2
(45) Date of Patent: Mar. 31, 2026

(54) COPPER ALLOY STRIP AND ITS PREPARATION METHOD

(71) Applicants: NINGBO BOWAY ALLOY PLATE AND STRIP CO., LTD., Zhejiang (CN); NINGBO POWERWAY ALLOY MATERIAL CO., LTD., Zhejiang (CN); NINGBO BOWAY NEW MATERIAL CO., LTD, Zhejiang (CN)

(72) Inventors: Xiangpeng Meng, Zhejiang (CN); Yongjun Pei, Zhejiang (CN); Jibao Li, Zhejiang (CN); Ning Li, Zhejiang (CN); Xuan Zhang, Zhejiang (CN); Ming Zhang, Zhejiang (CN); Renchang Hu, Zhejiang (CN); Lei Zhong, Zhejiang (CN)

(73) Assignees: NINGBO BOWAY ALLOY PLATE AND STRIP CO., LTD., Zhejiang (CN); NINGBO POWERWAY ALLOY MATERIAL CO.,LTD., Zhejiang (CN); NINGBO BOWAY NEW MATERIAL CO.,LTD, Zhejiang (CN)

( * ) Notice: Subject to any disclaimer, the term of this patent is extended or adjusted under 35 U.S.C. 154(b) by 373 days.

(21) Appl. No.: 18/337,455

(22) Filed: Jun. 20, 2023

(65) Prior Publication Data

US 2024/0035120 A1 Feb. 1, 2024

(30) Foreign Application Priority Data

Jul. 29, 2022 (CN) ..... 202210902788.X

(51) Int. Cl.
*C22C 9/00* (2006.01)
*C22F 1/08* (2006.01)

(52) U.S. Cl.
CPC . *C22C 9/00* (2013.01); *C22F 1/08* (2013.01)

(58) Field of Classification Search
None
See application file for complete search history.

(56) References Cited

U.S. PATENT DOCUMENTS

2001/0052377 A1* 12/2001 Hirai ..... C22C 9/04 148/412

FOREIGN PATENT DOCUMENTS

JP 2006283059 A * 10/2006
JP 2013173988 A * 9/2013

* cited by examiner

*Primary Examiner* — Jenny R Wu
(74) *Attorney, Agent, or Firm* — JCIPRNET

(57) ABSTRACT

The invention provides a copper alloy strip, wherein the copper alloy comprises the following components in percentage by mass: 0.1 wt %-1.0 wt % of Cr, 0.01 wt %-0.2 wt % of Si, 0.01 wt %-1.0 wt % of X and the balance of Cu and inevitable impurities, wherein X is at least one of Fe, Ti, Zr, Ag, Zn and Sn; on a section of the copper alloy strip perpendicular to a rolling direction, the number of second-phase particles having a particle size of 5 nm or below 5 nm is A, the number of second-phase particles having a particle size of 100 nm or above 100 nm is B, and A/B is greater than or equal to 3.

3 Claims, No Drawings

COPPER ALLOY STRIP AND ITS PREPARATION METHOD

CROSS-REFERENCE TO RELATED APPLICATION

This application claims the priority benefit of Chinese application serial no. 202210902788.X, filed on Jul. 29, 2022. The entirety of the above-mentioned patent application is hereby incorporated by reference herein and made a part of this specification.

BACKGROUND

Technical Field

The present invention belongs to the technical field of copper alloys and particularly relates to a copper alloy strip and its preparation method.

Description of Related Art

As electronic information products become smaller, thinner, lighter, more functional, and more intelligent, integrated circuits are developing towards large-scale integrated circuits and ultra-large-scale integrated circuits. Copper alloy lead frames used in integrated circuits are advanced in the direction of fine lead pitch and multi-pin. Compared with the traditional lead frame, a package lead frame has a smaller lead pitch, which is much smaller than the lead pitch of the traditional lead frame. Such a small lead pitch cannot be reached by a cemented carbide stamping die, but the production of a lead frame with the highest density and the largest number of pins can be achieved by an etching process. Due to the multi-lead and small-pitch features of the lead frame, the etching forming processing method can be more widely used, and higher requirements are put forward for the performance of copper alloys.

As lead frame materials, copper alloys are required to have good electrical conductivity, thermal conductivity, strength, corrosion resistance, and heat resistance. Therefore, copper-based materials used for lead frames are all high-performance copper alloys with precipitation strengthening characteristics. Under the multiple effects of solid solution strengthening, deformation strengthening and aging precipitation strengthening, the high strength of the material is achieved and the loss of electrical conductivity is minimized, thereby achieving a good match between the mechanical properties and electrical conductivity required by the lead frames. Commonly used high-performance copper alloys are mainly copper alloys of CuFeP, CuNiSi and CuCrZr systems, including alloys such as C18045, C19210, C19400 and C70250 and their improved systems. In recent years, some niche brand frame materials have been developed in China, such as Cu—Sn alloys, micro-alloyed Cu—Cr alloys and the like.

In addition to meeting all the technical indicators of a punched lead frame strip, the etched lead frame material puts forward higher requirements for the surface quality, plate shape, residual stress and the like of a strip product, which basically represents the highest technical level of lead frame strip processing. The main problems of etched products are insufficient technical indicators such as surface flatness, plate shape and residual stress. Especially for semi-etched products, in addition to problems in controlling the residual stress distribution and its uniformity, it is also difficult to control the surface flatness of the strip stably.

SUMMARY

A first technical problem to be solved by the present invention is to provide a copper alloy strip with excellent comprehensive properties such as strength, electrical conductivity, surface flatness and uniform distribution of residual stress.

A technical solution adopted by the present invention to solve the first technical problem is: a copper alloy strip, wherein the copper alloy comprises the following components in percentage by mass: 0.1 wt %-1.0 wt % of Cr, 0.01 wt %-0.2 wt % of Si, 0.01 wt %-1.0 wt % of X and the balance of Cu and inevitable impurities, wherein X is at least one of Fe, Ti, Zr, Ag, Zn and Sn; on a section of the copper alloy strip perpendicular to a rolling direction, the number of second-phase particles having a particle size of 5 nm or below 5 nm is A, the number of second-phase particles having a particle size of 100 nm or above 100 nm is B, and A/B is greater than or equal to 3.

In the present invention, Cr is dissolved into a copper matrix through solid solution treatment to form a supersaturated solid solution, and then second-phase particles are precipitated through aging treatment. Since the maximum solid solubility of Cr element in the copper matrix is about 0.65 wt % at a high temperature and the solid solubility is relatively low at room temperature, during the solidification process, some Cr elements form second-phase particles with uneven size (the small ones are only a few nanometers, and the large ones reach hundreds of nanometers) in the matrix by means of phase transition and other methods. These second-phase particles are dispersedly distributed in the alloy matrix, which improves the hardness of the alloy. In the subsequent cold working, the precipitated second-phase particles interact violently with the dislocations, which greatly increases the dislocation density in the alloy matrix, thereby improving the strength of the alloy. If the Cr content is too high, more large-sized second-phase particles will be precipitated, which will increase the resistivity of the alloy, deteriorate the surface roughness of the alloy and adversely affect the uniform distribution of residual stress. If the Cr content is too low, the effect of precipitation strengthening cannot be insufficiently produced. Therefore, the Cr content of the copper alloy strip of the present invention is in the range of 0.1 wt % to 1.0 wt %.

The addition of an appropriate amount of Si element can deoxidize and purify the melt, promote the fluidity in the smelting process and also refine the second-phase particles containing Cr, thereby increasing the strengthening effect of the precipitated phase. The addition of a small amount of Si element can effectively improve the strength of the alloy, and has little effect on the electrical conductivity. If the Si content is too high, the particles of the precipitated phase will increase and coarsen, and there will be obvious segregation tendency, which will affect the electrical conductivity and surface smoothness of the alloy seriously. Otherwise, the precipitated phase cannot be refined obviously if the Si content is too low. Therefore, the Si content of the copper alloy strip of the present invention is controlled within a range of 0.01 wt % to 0.2 wt %.

Element X is mainly a solid dissolved in copper to achieve solid solution strengthening, which is beneficial to improving the mechanical properties of the copper alloy strip of the present invention. Fe element can form Si oxide precipitates with Si, thereby achieving dispersion strengthening, and it is also beneficial to further improving the strength and hardness of the copper alloy strip of the present invention. Ti can improve the high-temperature softening temperature of copper alloy. Zr can also form Cr—Zr precipitate phase with Cr, which is beneficial to improving the tensile strength of the copper alloy strip of the present invention. Ag, Zn and Sn are slightly different from Cu in atomic radius, which has insignificant effect on the electrical conductivity of the alloy when solid solution strengthening works. If the content of the above elements is too low, the effect will not be obvious. If the content is too high, the electrical conductivity of the copper alloy strip of the present invention will be obviously reduced, and the surface flatness will also be adversely affected. Therefore, the content of the X element in the copper alloy strip of the present invention is controlled within a range of 0.01 wt % to 1.0 wt %.

In the copper alloy strip of the present invention, dispersedly distributed fine second-phase particles are introduced, bringing about high-density dislocation entanglement, thereby ensuring the high strength and high electrical conductivity of the alloy and also improving the surface flatness of the strip. After aging precipitation, elements such as Cr and Si in the alloy will form second-phase particles with uneven size that are dispersedly distributed in the copper matrix. These second-phase particles introduce high-density dislocations, sub-grain boundaries and other defects in the matrix, which have a positive impact on the hardness and electrical conductivity of the alloy. With the increase of the dispersion degree of the fine second-phase particles dispersed in the grains, the hardness of the alloy reaches its peak. Compared with the above-mentioned fine second-phase particles, the coarse second-phase particles are mostly distributed at the grain boundary, which has a weak strengthening effect on the alloy. In addition, the segregation and coarsening of the precipitated phase will reduce the local hardness of the alloy, resulting in a decrease in the accuracy of the cold-worked plate shape control of the alloy, and seriously affecting the surface flatness. Therefore, the number of coarse second-phase particles should be controlled as small as possible. On the section of the copper alloy strip of the present invention perpendicular to the rolling direction, the number of second-phase particles with a particle size of 5 nm or below 5 nm is A, the number of second-phase particles with a particle size of 100 nm or above 100 nm is B, and $A/B \geq 3$. Since the grain boundary hinders the deformation, and the deformation of the coarse second-phase particles at the grain boundary is quite different from that of the fine second-phase particles in the grain, when $A/B \geq 3$, the tendency of the incongruous deformation and local stress concentration in the alloy can be controlled at a low level. In this case, the alloy strip has a good surface flatness and a relatively uniform distribution of residual stress.

Preferably, on the section of the copper alloy strip perpendicular to the rolling direction, the second-phase particles with a particle size of 5 nm or below 5 nm are mainly CrSi compounds, and the second-phase particles with a particle size of 100 nm or above 100 nm are mainly elemental Cr.

Preferably, the microstructure of the copper alloy strip includes copper-type texture and Goss texture, and the ratio of the area ratio of the copper-type texture to the area ratio of the Goss texture is controlled at 1.0-3.0. When the proportion of copper texture is high and the proportion of Goss texture is low, the alloy strip has good flatness and uniformly distributed residual stress, thus ensuring its good etching performance. Otherwise, when the proportion of copper-type texture is low and the proportion of Goss texture is too high, the surface flatness of the alloy strip will be poor, and the etching performance will deteriorate accordingly, which will seriously cause fracture due to non-uniform stress distribution after etching. Controlling the area ratio of the copper-type texture and the Goss texture in the copper alloy strip of the present invention can ensure the improvement in the surface flatness and residual stress distribution of the copper alloy strip of the present invention while obtaining good strength and electrical conductivity. Therefore, the ratio of the area ratio of the copper-type texture to the area ratio of the Goss texture is controlled at 1.0-3.0.

Preferably, the copper alloy further includes 0.01 wt %-0.5 wt % of M in percentage by mass, and M is at least one of Ni, Co, Mn, Mg, P, and Re.

Element M can have a strengthening effect to a certain extent. In the casting process, the element M can also be used as a nucleation center to increase the nucleation rate of the copper alloy strip of the present invention, thereby refining the crystal grains. A fine-grained ingot provides initial organizational conditions for the preparation of the fine-grained copper alloy strip, which helps to improve the tensile strength of the copper alloy strip of the present invention. When the content of the optional element is lower than a lower limit, the effect of grain refinement is not obvious, and when the content of the optional element is higher than an upper limit, excessive element M will increase the occurrence of surface defects such as scratches and dents in the strip of the present invention during processing.

Preferably, the copper alloy strip has a tensile strength of 500 MPa or above 500 MPa, an electrical conductivity of 60% IACS or above 60% IACS, a thickness fluctuation rate of less than 4% or equal to 4%, and a standard deviation of residual stress of less than 10 MPa or equal to 10 MPa.

A second technical problem to be solved by the present invention is to provide a preparation method of a copper alloy strip.

The technical solution adopted by the present invention to solve the second technical problem is: a preparation method of a copper alloy strip, including the following process flow: casting→homogenizing annealing→hot rolling→solid solution treatment→primary cold rolling→aging treatment→secondary cold rolling→low-temperature annealing; the initial temperature of the hot rolling is 950° C.-1000° C., the total deformation of the hot rolling is 90% or above 90%, and a processing rate in a temperature range from the initial temperature to 880° C. is not less than 50% of the total processing rate of the hot rolling.

Hot rolling: Hot rolling is carried out at an initial temperature of 950° C.-1000° C. to ensure that alloying elements are fully dissolved into a copper matrix and crystal grains do not grow. When the initial temperature is lower than 950° C., the dispersion of solute atoms is insufficient, and the deformation resistance increases during hot rolling, resulting in cracking. When the initial temperature is higher than 1000° C., overheating or overburning may occur, which will also cause cracking in hot rolling. The total processing rate of hot rolling is greater than 90% or equal to 90%, and the processing rate in the temperature range from the initial temperature to 880° C. is not less than 50% of the total processing rate of hot rolling, so as to ensure that the copper-type texture with an area content of more than 40% is formed in the copper alloy strip of the present invention after hot rolling, thereby providing an initial environment for the formation of a specific texture and area ratio in the copper alloy strip of the present invention, and also making a preparation for the formation of dispersedly distributed fine second-phase particles in the subsequent finished strips, and reducing the formation of coarse second-phase particles.

When hot rolling is carried out within a range of temperature above 880° C., as the degree of deformation increases during the hot rolling process, the grains of the alloy are gradually refined, the number of large-sized grains is gradually reduced, the alloy structure is gradually elongated along the rolling direction, the grains are broken to a large extent, and the number of grain boundaries increases, but when the deformation exceeds a certain level, the grains are extremely refined, and the nucleation points of coarse second-phase particles decrease with the shortening of the grain boundary length, and the second-phase particles are more likely to be distributed in the grains as fine particles.

Preferably, the aging treatment is carried out step by step. In the first step, the strip is heated to 200° C.-400° C. and held for 0.5 h-4 h, and in the second step, the strip is heated to 400° C.-550° C. and held for 2 h-10 h. In the first step of aging treatment, a relatively low temperature is adopted to generate a high-density nucleation area in the matrix, which provides nucleation points for the uniform precipitation of the second phase, and because the holding time is relatively short, less internal energy is provided. In the first step, the alloy grains do not grow significantly, the second phase does not precipitate massively, and more energy is accumulated for the second step. The alloy strip of the present invention has sufficient precipitation power stored in the initial stage of aging treatment, and the supersaturation of the matrix is large. In this case, the second phase is precipitated at a very high speed. Therefore, the second step of aging treatment adopts a relatively high temperature, so that the second phase can be fully precipitated and dispersedly distributed in the alloy matrix in a short time, and the second-phase particles are more uniform and finer. In order to make the solute atoms in the alloy matrix precipitate more thoroughly, enough holding time needs to be given in the second step to ensure that the solute atoms are further dispersed.

Preferably, the total time of the aging treatment does not exceed 12 h, so as to prevent deterioration of the surface flatness and residual stress distribution of the finished alloy strip caused by the segregation and coarsening of the second phase.

Preferably, the total processing rate of the primary cold rolling is between 50% and 90%, and the total processing rate of the secondary cold rolling is between 20% and 50%. The cold rolling process after solid solution can adjusting the strip size and also provide the driving force for aging precipitation. With the increase in the degree of cold rolling deformation, dislocations in the matrix continues to proliferate, which increases the driving force for alloy precipitation. Moreover, the high-density dislocations also provide nucleation sites and diffusion paths for the precipitation of solute atoms, which improves its ability to disperse in the matrix, thereby effectively promoting the precipitation of the second phase. The total processing rate of one-time cold rolling is between 50% and 90%. If the total processing rate of one-time cold rolling is less than 50%, it will not be able to provide sufficient driving force for aging precipitation, and the precipitation of the second phase is insufficient, resulting in the finished product of the alloy strip. Insufficient strength and hardness. If the processing rate is greater than 90%, the effect of work hardening of the alloy strip increases, and at the same time, the electron scattering effect is intensified, resulting in a decrease in the electrical conductivity of the finished strip. The total processing rate of the secondary cold rolling is 20% and 50%. If the processing rate of the secondary cold rolling is too low or too high, the copper-type texture will be converted to other textures too much, so that the strip cannot obtain an ideal flatness, and the residual stress distribution of the finished product will be affected adversely.

Preferably, the low-temperature annealing is carried out at a temperature between 200° C. and 400° C., and the holding time is 10 min-30 min. Since the strip after secondary cold rolling is annealed at a low temperature, the internal stress is eliminated and the texture distribution of the finished strip is adjusted and controlled, thereby obtaining a finished copper alloy strip with good surface flatness and uniform residual stress distribution.

Compared with the prior art, the present invention has the following advantages: By controlling the addition of Cr and Si, the ratio of the number of second-phase particles having a particle size of 5 nm or below 5 nm to the number of second-phase particles having a particle size of 100 nm or above 100 nm on the section of the copper alloy strip perpendicular to the rolling direction is limited, thereby ensuring the high strength and high conductivity of the alloy and also improving the flatness of the surface of the strip and ensuring the evenly distributed residual stress. The copper alloy strip of the present invention has a tensile strength of 500 MPa or above 500 MPa, an electrical conductivity of 60% IACS or above 60% IACS, a thickness fluctuation rate of less than 4% or equal to 4%, and a standard deviation of residual stress of less than 10 MPa or equal to 10 MPa. The high tensile strength and good electrical conductivity are maintained and the surface flatness is good, which can meet the performance requirements of etched and half-etched products such as lead frames.

DESCRIPTION OF THE EMBODIMENTS

With reference to the embodiments, the present invention will be described in more details below.

The present invention provides 16 examples and 4 comparative examples, and the specific components are shown in Table 1.

The preparation process of the copper alloy strip in the embodiments is: casting→homogenizing annealing→hot rolling→solid solution→treatment primary→cold rolling→aging treatment→secondary cold rolling→low-temperature annealing, and the specific steps are as follows.

1) Casting: Components are prepared as required, and melting is carried out in an induction furnace. After testing, the composition meets the requirements, and the casting is carried out after sufficient degassing and slag removal. The casting temperature is 1250° C.
2) Homogenizing annealing: The ingot is heated to 1020° C. for 1 h.
3) Hot rolling: At the initial temperature of 950-1000° C., the hot rolling blanking is carried out, the total processing rate of hot rolling is greater than 90% or equal to 90%, and the processing rate in a temperature range from the initial temperature to 880° C. is not less than 50% of the total processing rate of hot rolling.
4) Solid solution treatment: Solid solution treatment is carried out on the hot-rolled alloy strip at 950° C. for 30 min, and the alloy strip is then rapidly cooled by water quenching.
5) Primary cold rolling: After solid solution treatment, the strip is subjected to primary cold rolling, and the total processing rate of primary cold rolling is between 50% and 90%.
6) Aging treatment: Aging treatment is carried out on the strip after the primary cold rolling process. The aging treatment is carried out step by step. In the first step, the strip is heated to 200° C.-400° C. and held for 0.5 h-4 h, and in the second step, the strip is heated to 400° C.-550° C. and held for 2 h-10 h.

7) Secondary cold rolling: After aging treatment, the strip is washed and then subjected to secondary cold rolling. The total processing rate of secondary cold rolling is between 20% and 50%.

8) Low-temperature annealing: low-temperature annealing is carried out on the finished strip at a temperature of 200° C.-400° C., and the holding time is 10 min-30 min.

The ratio of the processing rate in the temperature range from the initial temperature to 880° C. to the total processing rate of hot rolling is defined as C, and C=processing rate in the temperature range from the initial temperature to 880° C./total processing rate of hot rolling*100%.

The key process parameters of the embodiments are shown in Table 2.

Comparative Example 1 differs from Example 1 in that the processing rate in the temperature range from the initial temperature to 880° C. is 30% of the total processing rate of hot rolling.

Comparative Example 2 differs from Example 1 in that the total processing ratio of the primary cold rolling is 40%.

Comparative Example 3 differs from Example 1 in that one-step aging is adopted, the aging temperature is 400° C., and the aging time is 18 h.

Comparative Example 4 differs from Example 1 in that the total processing rate of the secondary cold rolling is 60%.

The copper alloy strips obtained in Examples and Comparative Examples were tested as follows.

Tensile strength: The room-temperature tensile test was carried out in accordance with GB/T 228.1-2010 Metallic Materials-Tensile Tests Part 1: Room-Temperature Test Method on an electronic universal mechanical property test machine with a tensile speed of 5 mm/min.

Electrical conductivity: The electrical conductivity of the strips was test in accordance with GB/T 32791-2016 Electromagnetic (eddy-current) Examination Method for Electrical Conductivity of Copper and Copper Alloys.

Texture: EBSD was used to analyze the texture type and area ratio of the strips. The so-called area ratio of each orientation was calculated by dividing the area within 15° of the deviation angle of each orientation by the measured area. The ratio of the area ratio of { 112}<111> copper-type texture to the area ratio of {011}<100> Goss texture was also calculated.

Second phase: A transmission electron microscope was used to randomly set observation areas within the field of view observed on the cross section of the strip, and the above observation areas were 400 nm×250 nm rectangles. In the copper matrix part in the observation area, five points were randomly selected for EDS analysis, and the average value of the determined detection intensity of the Cr element was denoted as $I_a$. Next, particles with a contrast different from that of the copper matrix were used as the test object to carry out EDS analysis under the same test conditions, and the number of particles with a Cr element detection intensity more than 10 times that of $I_a$ was measured and counted. The number of particles having a particle size of 5 nm or below 5 nm was denoted as A, the number of particles having a particle size of 100 nm or above 100 nm was denoted as B, and the value of A/B was calculated.

Thickness fluctuation rate: A strip sample with a length of 500 mm was prepared, 10 consecutive points were taken in the rolling direction at intervals of 50 mm to measure the thickness of the sample with a thickness gauge, and the ratio of the difference between the maximum and minimum values of the above ten thickness values to the average of the ten thickness values was then calculated as thickness fluctuation rate.

Standard deviation of residual stress: A 50×5 mm strip sample was prepared and 20 points were taken randomly. The residual stress value at each point was measured according to ASTM E1426-2014 Standard Test Method for Determining the X-Ray Elastic Constants for Use in the Measurement of Residual Stress using X-Ray Diffraction, and its standard deviation was calculated.

The test results of the microstructures and properties of strips in Examples and of the invention and Comparative Examples are shown in Table 3. It can be seen from the comparison of various properties measured in Table 3 that, compared with Comparative Examples, Examples of the present invention have the ratio (A/B) of the coarse second-phase particles to the fine second-phase particles in the microstructures of the copper alloy strips being greater than or equal to 3, and the ratio of the area ratio of {112}<111> copper-type texture to the area ratio of {011}<100> Goss texture being in the range of 1.0 to 3.0. Therefore, the tensile strength of the copper alloy strip is 500 MPa or above 500 MPa, and the electrical conductivity is 60% IACS or above 60% IACS; the thickness fluctuation rate of the strip is less than 4% or equal to 4%, and the standard deviation of residual stress is less than 10 MPa or equal to 10 MPa. The strip of the present invention shows both excellent tensile strength and good electrical conductivity, can ensure good surface flatness, and is suitable for etched and half-etched products such as lead frames.

TABLE 1

Composition of strips in Examples and Comparative Examples

| | | Alloy element/wt % | | | | | | | | | |
|---|---|---|---|---|---|---|---|---|---|---|---|
| | | | | X | | | | | | | |
| Group | | Cr | Si | Fe | Ti | Zr | Ag | Zn | Sn | Y | Cu |
| Example | 1 | 0.17 | 0.11 | 0.59 | | | | | | | Balance |
| | 2 | 0.37 | 0.15 | | 0.03 | | | | | | |
| | 3 | 0.86 | 0.11 | | | 0.05 | | | | | |
| | 4 | 1 | 0.09 | | | | 0.16 | | | | |
| | 5 | 0.58 | 0.02 | | | | | 0.8 | | | |
| | 6 | 0.37 | 0.03 | | | | | | 0.61 | | |
| | 7 | 0.6 | 0.11 | | 0.14 | 0.09 | | | | | |

TABLE 1-continued

| Composition of strips in Examples and Comparative Examples | | | | | | | | | | |
|---|---|---|---|---|---|---|---|---|---|---|
| | Alloy element/wt % | | | | | | | | | |
| | | | X | | | | | | | |
| Group | Cr | Si | Fe | Ti | Zr | Ag | Zn | Sn | Y | Cu |
| 8 | 0.49 | 0.19 | 0.06 | 0.09 | | 0.08 | | | | |
| 9 | 0.83 | 0.16 | 0.06 | | 0.17 | | | | | |
| 10 | 0.72 | 0.09 | | | | | 0.19 | 0.25 | | |
| 11 | 0.79 | 0.06 | | 0.1 | | 0.04 | 0.03 | | 0.42 Ni | |
| 12 | 0.25 | 0.03 | 0.18 | | 0.12 | | | 0.18 | 0.35 Co | |
| 13 | 0.37 | 0.07 | 0.11 | 0.16 | | | | 0.04 | 0.3 Mn | |
| 14 | 0.29 | 0.03 | 0.19 | | 0.06 | | 0.14 | | 0.09 Mg | |
| 15 | 0.54 | 0.16 | 0.06 | 0.15 | 0.16 | 0.06 | 0.19 | 0.14 | 0.07 P | |
| 16 | 0.3 | 0.15 | 0.19 | 0.16 | 0.04 | 0.14 | 0.2 | 0.13 | 0.06 Re | |

TABLE 2

| Control over key parameters of Examples and Comparative Examples of the invention | | | | | |
|---|---|---|---|---|---|
| | Hot rolling | | | | |
| Group | Initial temperature/° C. | Total processing rate/% | C | Primary cold rolling Total processing rate/% | |
| Example 1 | 950 | 90 | 50 | 90 | |
| 2 | 975 | 90 | 50 | 90 | |
| 3 | 1000 | 90 | 50 | 90 | |
| 4 | 975 | 90 | 70 | 90 | |
| 5 | 975 | 90 | 90 | 90 | |
| 6 | 975 | 95 | 70 | 90 | |
| 7 | 975 | 90 | 70 | 90 | |
| 8 | 975 | 90 | 70 | 90 | |
| 9 | 975 | 90 | 70 | 90 | |
| 10 | 975 | 90 | 70 | 90 | |
| 11 | 975 | 90 | 70 | 50 | |
| 12 | 975 | 90 | 70 | 60 | |
| 13 | 975 | 90 | 70 | 70 | |
| 14 | 975 | 90 | 70 | 80 | |
| 15 | 975 | 90 | 70 | 90 | |
| 16 | 975 | 90 | 70 | 90 | |

| | Aging treatment | | | | Secondary cold | Low-temperature annealing |
|---|---|---|---|---|---|---|
| Group | Aging temperature in first step/° C. | Holding time in first step/h | Aging temperature in second step/° C. | Holding time in second step/h | rolling Total processing rate/% | Temperature/° C. |
| Example 1 | 300 | 2 | 480 | 6 | 20 | 200 |
| 2 | 300 | 2 | 480 | 6 | 20 | 200 |
| 3 | 300 | 2 | 480 | 6 | 20 | 200 |
| 4 | 300 | 2 | 480 | 6 | 20 | 200 |
| 5 | 300 | 2 | 480 | 6 | 20 | 200 |
| 6 | 200 | 2 | 480 | 6 | 20 | 200 |
| 7 | 400 | 2 | 480 | 6 | 20 | 200 |
| 8 | 300 | 0.5 | 480 | 6 | 20 | 200 |
| 9 | 300 | 1 | 480 | 6 | 20 | 200 |
| 10 | 300 | 4 | 480 | 6 | 20 | 200 |
| 11 | 300 | 2 | 400 | 6 | 40 | 200 |
| 12 | 300 | 2 | 550 | 6 | 35 | 200 |
| 13 | 300 | 2 | 480 | 2 | 30 | 200 |
| 14 | 300 | 2 | 480 | 4 | 25 | 200 |
| 15 | 300 | 2 | 480 | 8 | 20 | 300 |
| 16 | 300 | 2 | 480 | 10 | 20 | 400 |

TABLE 3

| Microstructure and properties of Examples and Comparative Examples of the invention | | | | | | | |
|---|---|---|---|---|---|---|---|
| | Property | | | | | Microstructure | |
| Group | | Tensile strength/Mpa | Electrical conductivity/% IACS | Thickness fluctuation rate/% | Standard deviation of residual stress/MPa | Texture ratio* | Quantity ratio of second phase (A/B) |
| Example | 1 | 506 | 81.2 | 1.43 | 4 | 2.5 | 5.26 |
| | 2 | 522 | 73.4 | 2.40 | 1.1 | 1.6 | 5.56 |
| | 3 | 521 | 65.3 | 1.77 | 3.2 | 2.7 | 3.5 |
| | 4 | 529 | 62 | 0.67 | 2.1 | 1.9 | 3.56 |
| | 5 | 529 | 65.8 | 3.03 | 1.3 | 2.2 | 7.14 |
| | 6 | 543 | 67.6 | 2.07 | 6.8 | 2.5 | 10 |
| | 7 | 545 | 69.3 | 3.03 | 4.7 | 2.4 | 3.1 |
| | 8 | 572 | 68.3 | 1.13 | 3.6 | 2.9 | 4.76 |
| | 9 | 555 | 62 | 1.43 | 2 | 1.7 | 3.03 |
| | 10 | 626 | 64.5 | 2.57 | 5.8 | 2.2 | 4.76 |
| | 11 | 553 | 65.2 | 1.47 | 3.1 | 2.4 | 25.2 |
| | 12 | 619 | 78.9 | 1.07 | 7.7 | 1.8 | 11.11 |
| | 13 | 541 | 68.4 | 2.67 | 2.6 | 1.9 | 9.09 |
| | 14 | 565 | 76.6 | 2.27 | 1.7 | 1.1 | 4.55 |
| | 15 | 562 | 67.6 | 1.97 | 3.9 | 3 | 33.33 |
| | 16 | 571 | 74 | 2.03 | 6.6 | 1.9 | 12.5 |
| Comparative Example | 1 | 510 | 78.2 | 7.43 | 12.5 | 1.2 | 1.5 |
| | 2 | 482 | 80.1 | 6.52 | 11.2 | 2.1 | 2.42 |
| | 3 | 505 | 81 | 8.24 | 14.7 | 1.6 | 1.25 |
| | 4 | 562 | 72.6 | 5.76 | 13.1 | 0.9 | 5.14 |

*Texture ratio refers to the ratio of the area ratio of {112}<111> copper-type texture to the area ratio of {011}<100> Goss texture was also calculated.

What is claimed is:

1. A copper alloy strip, comprising following components in percentage by mass: 0.1 wt %-1.0 wt % of Cr, 0.01 wt %-0.2 wt % of Si, 0.01 wt %-1.0 wt % of X and balance of Cu and inevitable impurities, wherein X is at least one of Fe, Ti, Zr, Ag, Zn and Sn; on a section of the copper alloy strip perpendicular to a rolling direction, a number of second-phase particles having a particle size of 5 nm or below 5 nm is A, a number of second-phase particles having a particle size of 100 nm or above 100 nm is B, and A/B is greater than or equal to 3, wherein a microstructure of the copper alloy strip comprises copper texture and Goss texture, and an area ratio of the copper texture to the Goss texture is controlled at 1.0-3.0.

2. The copper alloy strip according to claim 1, wherein the copper alloy strip further comprises 0.01 wt %-0.5 wt % of M in percentage by mass, and M is at least one of Ni, Co, Mn, Mg, P, and Re.

3. The copper alloy strip according to claim 1, having a tensile strength of 500 MPa or above 500 MPa, an electrical conductivity of 60% IACS or above 60% IACS, thickness fluctuation rate of less than 4% or equal to 4%, and a standard deviation of residual stress of less than 10 MPa or equal to 10 MPa.

* * * * *